US006689967B2

(12) United States Patent
Myojin

(10) Patent No.: US 6,689,967 B2
(45) Date of Patent: Feb. 10, 2004

(54) SLIDE SWITCH

(75) Inventor: Satoshi Myojin, Tokyo (JP)

(73) Assignee: Mitsuku Denshi Kogyo K.K., Tokyo (JP)

( * ) Notice: Subject to any disclaimer, the term of this patent is extended or adjusted under 35 U.S.C. 154(b) by 0 days.

(21) Appl. No.: 10/093,389

(22) Filed: Mar. 11, 2002

(65) Prior Publication Data

US 2003/0168324 A1 Sep. 11, 2003

(51) Int. Cl.[7] ..... H01H 3/00
(52) U.S. Cl. ..... 200/18; 200/16 D
(58) Field of Search ..... 200/16 R, 16 F, 200/16 C, 16 D, 1 R, 1 B, 1 V, 18, 547, 550, 563

(56) References Cited

U.S. PATENT DOCUMENTS 4,361,739 A * 11/1982 Harata et al. ..... 200/16 C
4,475,015 A * 10/1984 Kobayashi et al. ..... 200/5 R
4,814,563 A * 3/1989 Migrin et al. ..... 200/260
4,931,781 A * 6/1990 Miyakawa ..... 345/160
5,349,143 A * 9/1994 Houser ..... 200/11 J
5,901,839 A * 5/1999 Sasaki et al. ..... 200/551

* cited by examiner

*Primary Examiner*—Michael Friedhofer
*Assistant Examiner*—Lisa Klaus
(74) *Attorney, Agent, or Firm*—Oblon, Spivak, McClelland, Maier & Neustadt, P.C.

(57) ABSTRACT

A slide switch capable of significantly reducing the number of parts therefor and facilitating assembling thereof. The slide switch includes a base provided thereon with fixed contacts, a slider provided thereon with a movable contact spring and arranged on the base so as to be movable in a desired direction while being guided by a combination of guide grooves and slide elements, and a restoring spring-equipped cover provided with restoring springs adapted to be pressed against four sides of the slider. The restoring spring-equipped cover is mounted on the base from a side of an upper surface of the slider, so that the slider slid in a desired direction may be returned to an original position by restoring force of the restoring springs, whereby selective contacting between the movable contact spring and the fixed contacts permits switching operation, mode changing-over operation and the like to be selectively carried out.

8 Claims, 14 Drawing Sheets

FIG.13
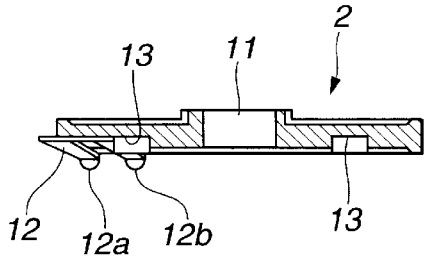
FIG.14(b)
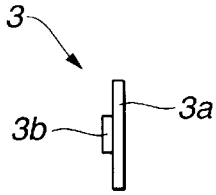
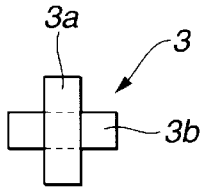
FIG.14(a)
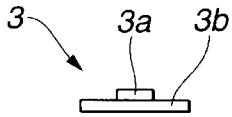
FIG.14(c)
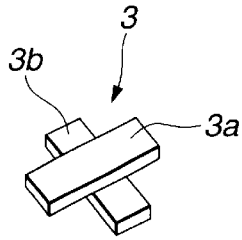
FIG.14(d)

SLIDE SWITCH

BACKGROUND OF THE INVENTION

This invention relates to a slide switch, and more particularly to a slide switch adapted to selectively carry out any desired switching action due to selective contacting between movable contacts and fixed contacts.

A variety of slide switches have been proposed for sliding a slider provided with movable contacts with respect to fixed contacts arranged on a base, a casing or the like to carry out selective contacting between both movable contacts and fixed contacts, resulting in accomplishing a switching action, a mode changing-over action or any other desired electric action. Also, various slide switches have been provided for permitting a slider slid in an intended or desired direction to be automatically returned to its original position by restoring force of any suitable spring means such as a leaf spring or the like.

Of such conventional slide switches proposed, a slide switch which is constructed so as to slide a slider in longitudinal and lateral four directions to carry out a switching action requires that four separate leaf springs are independently arranged at locations facing four sides of the slider in order to return the slider to its original position. This causes an increase in number of parts. In particular, such a slide switch is required to be small-sized into dimensions of, for example, about 15 mm in length, about 15 mm in width and about 3 to 5 mm in thickness and correspondingly the leaf springs are required to be small-sized into dimensions of about 10 to 12 mm in length, about 1 to 2 mm in width and about 0.1 to 0.2 mm in thickness. Thus, an increase in number of the parts causes assembling of the slide switch to be highly troublesome and time-consuming, leading to an increase in manufacturing cost and a variation in accuracy of the slide switch. This fails to permit the slide switch to stably exhibit a spring performance at uniform and increased accuracy.

Also, the prior art fails to permit sliding movement of the slider in an intended or desired direction to be accurately carried out with reduced force.

SUMMARY OF THE INVENTION

The present invention has been made in view of the foregoing disadvantage of the prior art.

Accordingly, it is an object of the present invention to provide a slide switch which is capable of significantly reducing the number of parts therefor and facilitating assembling thereof.

It is another object of the present invention to provide a slide switch which is capable of exhibiting uniform and increased performance while ensuring increased accuracy.

It is a further object of the present invention to provide a slide switch which is capable of smoothly moving a slider in any desired direction with respect to a base at increased accuracy.

In accordance with the present invention, a slide switch is provided. The slide switch includes a base provided thereon with fixed contacts, a slider provided thereon with a movable contact spring and arranged on the base so as to be movable in a desired direction while being guided by a combination of guide grooves and a slide elements, and a restoring spring-equipped cover provided with restoring springs adapted to be pressed against four sides of the slider. The restoring spring-equipped cover is mounted on the base from a side of an upper surface of the slider, so that the slider slid in a desired direction may be returned to its original position by restoring force of the restoring springs, whereby selective contacting between the movable contact spring and the fixed contacts permits a switching action, a mode changing-over action and the like to be selectively carried out.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein:

FIG. 13 is a sectional view taken along line G—G of FIG. 10;

FIGS. 14(*a*), 14(*b*), 14(*c*) and 14(*d*) are a front elevation view, a left side view, a bottom view and a perspective view each showing a slide element incorporated in the slide switch shown in FIG. 1, respectively;

DETAILED DESCRIPTION OF THE PREFERRED EMBODIMENT

Now, a slide switch according to the present invention will be described hereinafter with reference to the accompanying drawings.

Figure 1:
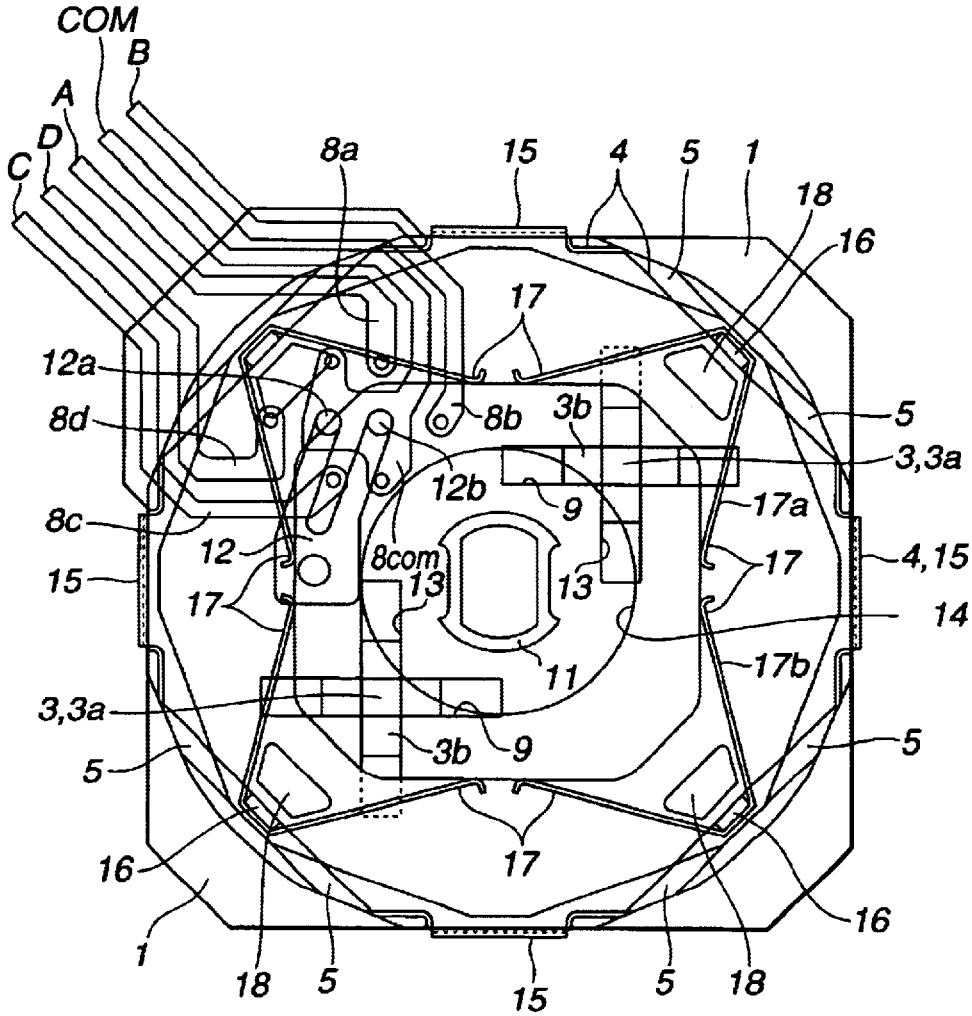
FIG. 1 is a front perspective elevation view showing an embodiment of a slide switch according to the present invention.

Referring first to FIG. 1, an embodiment of a slide switch according to the present invention is illustrated. A slide switch of the illustrated embodiment generally includes a base 1, a slider 2, slide elements 3 and a restoring spring-equipped cover 4 provided thereon with restoring spring 17.

The base 1 includes a bottom plate 7 and a peripheral wall 5 arranged on a peripheral edge of the bottom plate 7 and formed into a predetermined height. Such construction of the base 1 permits a recess 6 to be defined in the base 1 by the peripheral wall 5, in which the slider 2, the slide elements 3 and the restoring springs 17 of the restoring spring-equipped cover 4 are received. The bottom plate 7 has a plurality of fixed contacts 8 (8*a*, 8*b*, 8*c*, 8*d* and 8*com*) embedded in a part thereof. The fixed contacts 8 have terminals A, B, C, D and COM led out of the bottom plate so as to outwardly extend therefrom, respectively. Also, the bottom plate 7 is formed on a part thereof with guide grooves 9 of a predetermined length in which the slide elements 3 are fitted.

The slider 2 includes a plate member of a substantially square shape, which is so constructed that an operation section 11 is defined on a central portion thereof and a movable contact spring 12 is mounted on a portion thereof facing the fixed contacts 8 of the base 1. Also, the plate member is formed with guide grooves 13 of a predetermined length on a portion thereof facing the guide grooves 9 of the base 1 while being perpendicular thereto. The guide grooves 13 each have the slide element 3 fitted therein.

The slide elements 3 each include plate members 3*a* and 3*b* of a longitudinal shape connected to each other in a crossed manner and slidably fitted in the guide grooves 9 and 13.

The restoring spring-equipped cover 4 includes a spring plate of a square shape formed at a central portion thereof with a circular hole 14. The spring plate has engagements 15 formed by downwardly bending projections at four corners thereof. Also, the cover 4 includes spring elements 17*a* and 17*b* arranged so as to extend in parallel to each of four sides thereof and connected to each of the sides at a cental portion 16 thereof. The spring elements 17*a* and 17*b* are downwardly bent at the central portion 16 and inwardly bent so as to permit distal ends thereof to face each other inwardly of each of the engagements 15, resulting in the restoring springs 17 each being constituted by each pair of the spring elements 17*a* and 17*b*.

The thus-constructed slide switch is assembled by receiving the slider 2 in the recess 6 of the base 1 while aligning the operation section 11 of the slider 2 with a center of the base 1, fitting the slide elements 3 in the guide grooves 9 and 13 of the base 1 and slider 2 arranged in a crossed manner and contacting the movable contact spring 12 of the slider 2 with the corresponding fixed contacts 8. Then, the restoring spring-equipped cover 4 is arranged on an upper surface of the slider 2 while inserting the operation section 11 of the slider 2 through the circular hole 14 of the cover 4, so that the restoring springs 17 may be pressedly contacted with the slider 2 on the sides thereof and the engagements 15 at the corners of the cover 4 may be engaged with engagement projections 10 of the peripheral wall 5 of the base 1.

In the slide switch thus constructed and assembled, when the operation section 11 of the slider 2 is slid in a desired direction, the guide grooves 9 and 13 and slide elements 3 cooperate with other to permit the slider 2 to be moved in the desired direction. Concurrently, it permits the spring elements 17*a* and 17*b* of the restoring springs 17 pressed on the sides of the cover in the movement direction to be deflected, so that the movable contact springs 12 each may be contacted with the fixed contact 8 arranged at a target portion on the base, to thereby selectively carry out a switching action, a mode changing-over action or the like. Then, when the operation section 11 is released, the slider 2 is restored to the original position by restoring force of the restoring spring 17 deflected.

The illustrated embodiment may be constructed in such a manner as shown in FIGS. 3 to 9. More specifically, the bottom plate 7 of the base 1 is made of a dielectric material. The recess 6 of the base 1 in which the slider 2, the slide elements 3 and the restoring spring 17 of the restoring spring-equipped cover 4 are received is formed into a circular or polygonal shape. Also, the fixed contacts 8*a*, 8*b*, 8*c*, 8*d* and 8*com* are embedded in a part of the bottom plate 7 such as, for example, a quarter region thereof defined at an upper left portion thereof in a circuit-like pattern. The terminals A, B, C, D and COM of the fixed contacts 8*a*, 8*b*, 8*c*, 8*d* and 8*com* are arranged so as to outwardly extend from the bottom plate 7. Further, the guide grooves 9 in which the slide elements 3 are fitted are arranged on a part of the bottom plate 7 such as, for example, at quarter regions thereof defined at upper right and lower left portions thereof.

Alternatively, the illustrated embodiment may be constructed in such a manner as shown in FIGS. 10 to 13. The substantially square plate of the slider 2 is made of a dielectric material, which is cut out at four corners thereof. The operation section 11 is defined at a central portion of the thus-formed square plate. The plate is formed with an operation projection, a fit hole for an operation gripper the like. The plate is mounted with the movable contact spring 12 on a portion of a lower surface thereof facing the fixed contacts 8 of the base 1. The movable contact spring 12 may include, for example, two contact spring elements 12*a* and 12*b*. Further, the guide grooves 13 in which the slide elements 3 are received each are formed on a portion of the lower surface of the plate facing each of the guide grooves 9 of the base 1 while being perpendicular thereto.

The slide elements 3 each may be formed of two such plate members 3*a* and 3*b* of a rectangular or elongated shape connected to each other in a crossed manner and slidably fitted in the guide grooves 9 and 13. The plate members 3*a* and 3*b* each may be made of a dielectric material. The slider 2 is moved in longitudinal and lateral directions, in oblique longitudinal or lateral directions, in a circular pattern, in a curved pattern or in any suitable pattern or direction while keeping each of the slid elements 3 fitted in the guide grooves 9 and 13 of the base 1 and slider 2, as shown in FIG. 14.

The restoring spring-equipped cover 4 may be constructed in such a manner as shown in FIGS. 15 to 19. The spring plate of the cover 4 may be made of a dielectric metal plate and formed into a substantially square configuration. The square spring plate is formed at a central portion thereof with the circular hole 14 through which the operation section 11 of the slider 2 is inserted. Also, the engagements 15 of the plate are formed by downwardly bending the projections at the four corners of the plate. The spring elements 17*a* and 17*b* are arranged so as to be contiguous to the plate at the central portion 16 of each of the four sides of the plate and extend in parallel to each side. The spring elements 17*a* and 17*b* are downwardly bent at the central portion 16 and inwardly bent so as to permit the distal ends of the spring elements 17*a* and 17*b* to face each other inwardly of each of the engagements 15, resulting in forming the restoring spring 17.

Figure 2:
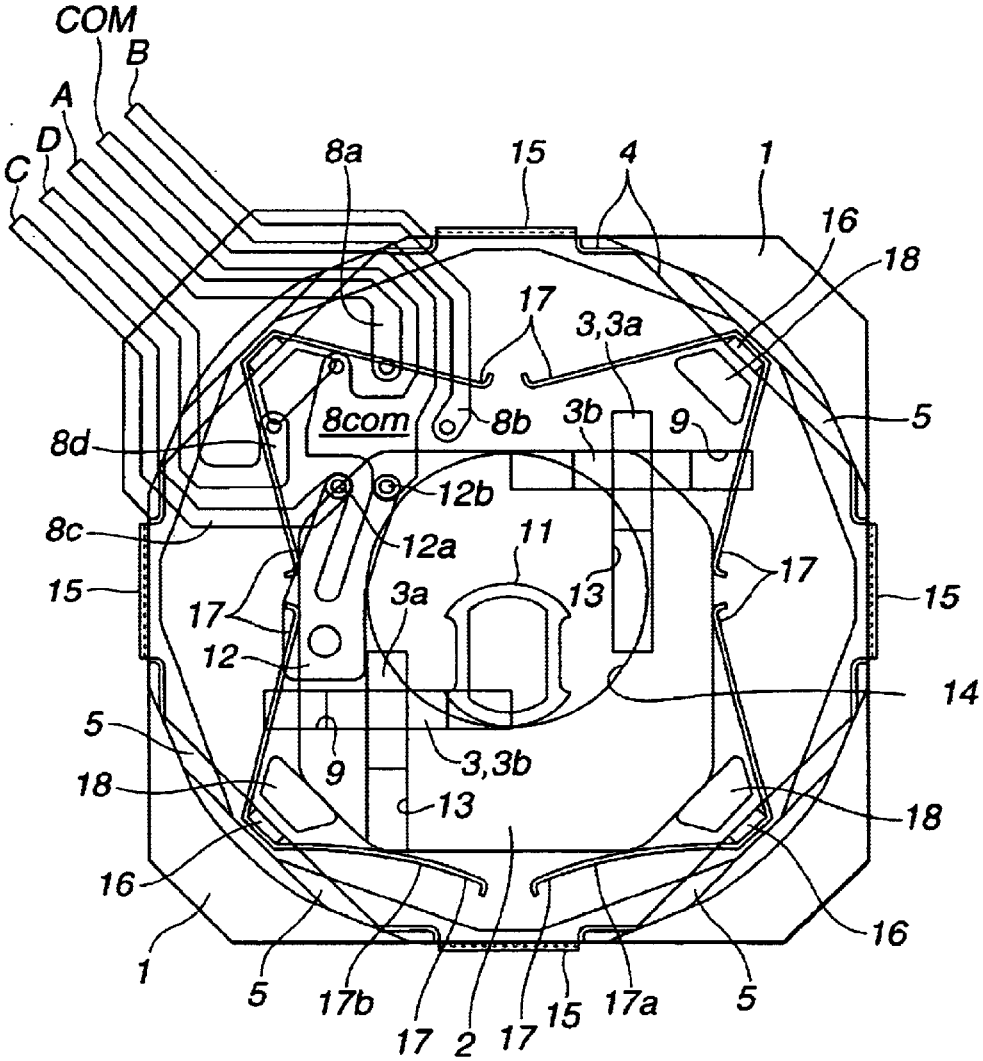
FIG. 2 is a front perspective elevation view of the slide switch shown in FIG. 1, in which the slide switch has been downwardly slid.
Figure 3:
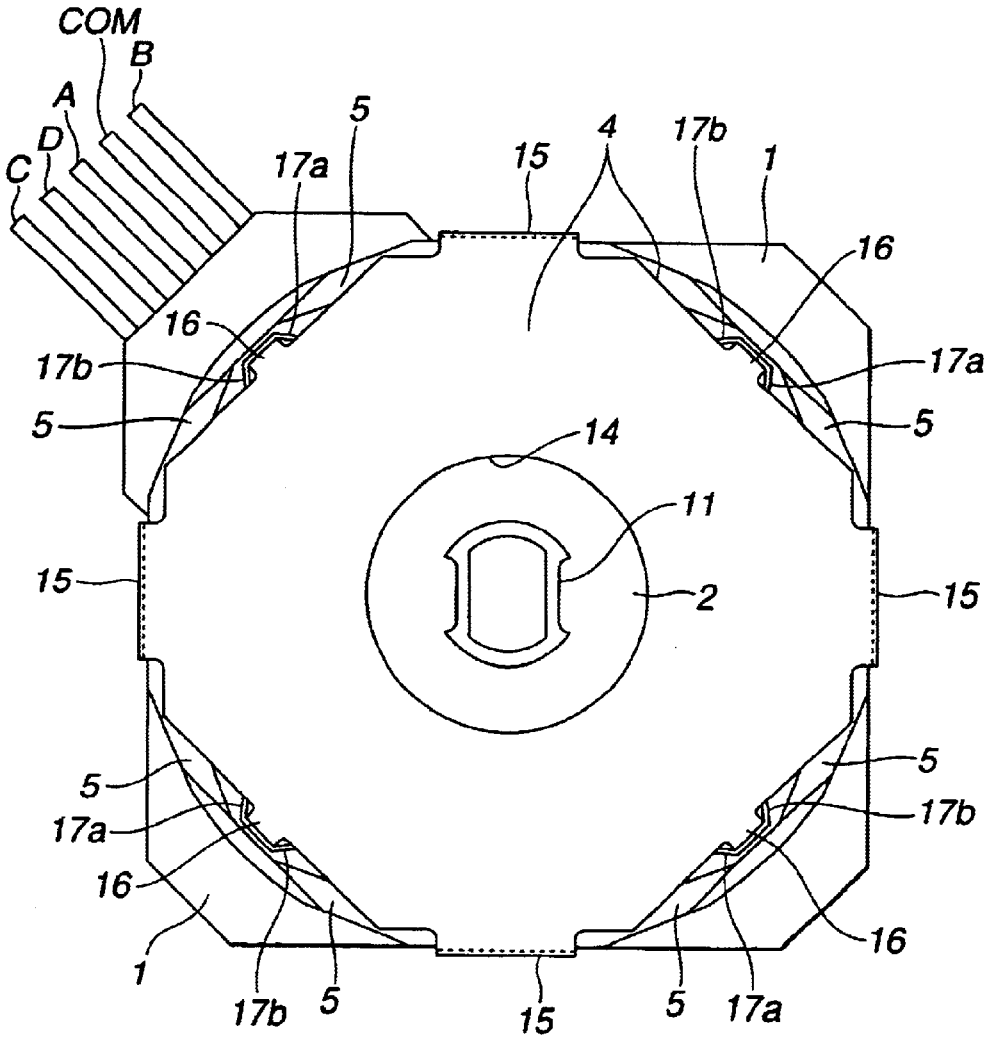
FIG. 3 is a front elevation view of the slide switch shown in FIG. 1.
Figure 4:
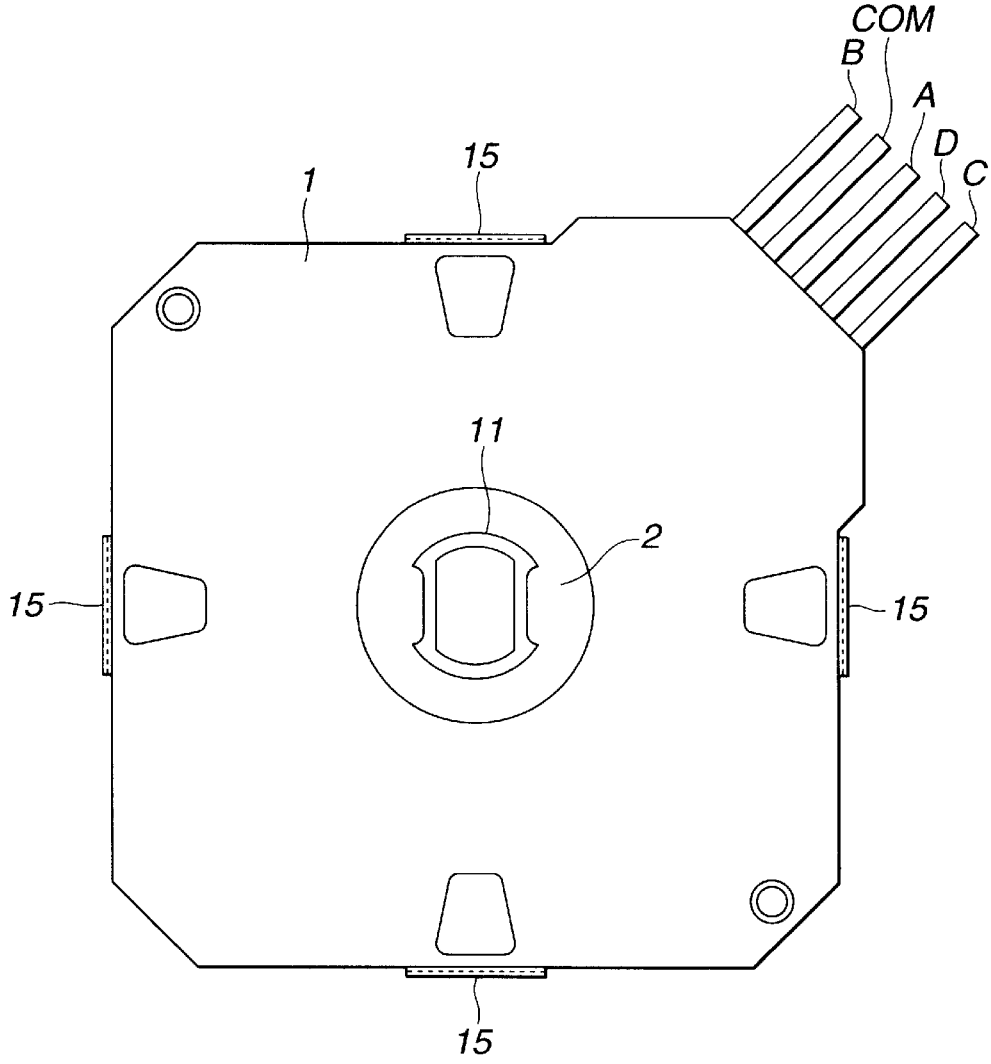
FIG. 4 is a rear view of the slide switch shown in FIG. 3.
Figure 5:
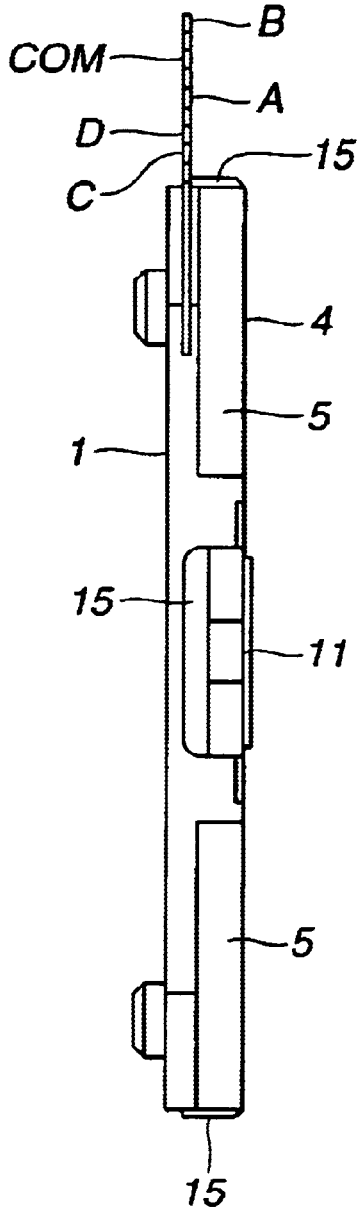
FIG. 5 is a left side elevation view of the slide switch shown in FIG. 3.
Figure 6:
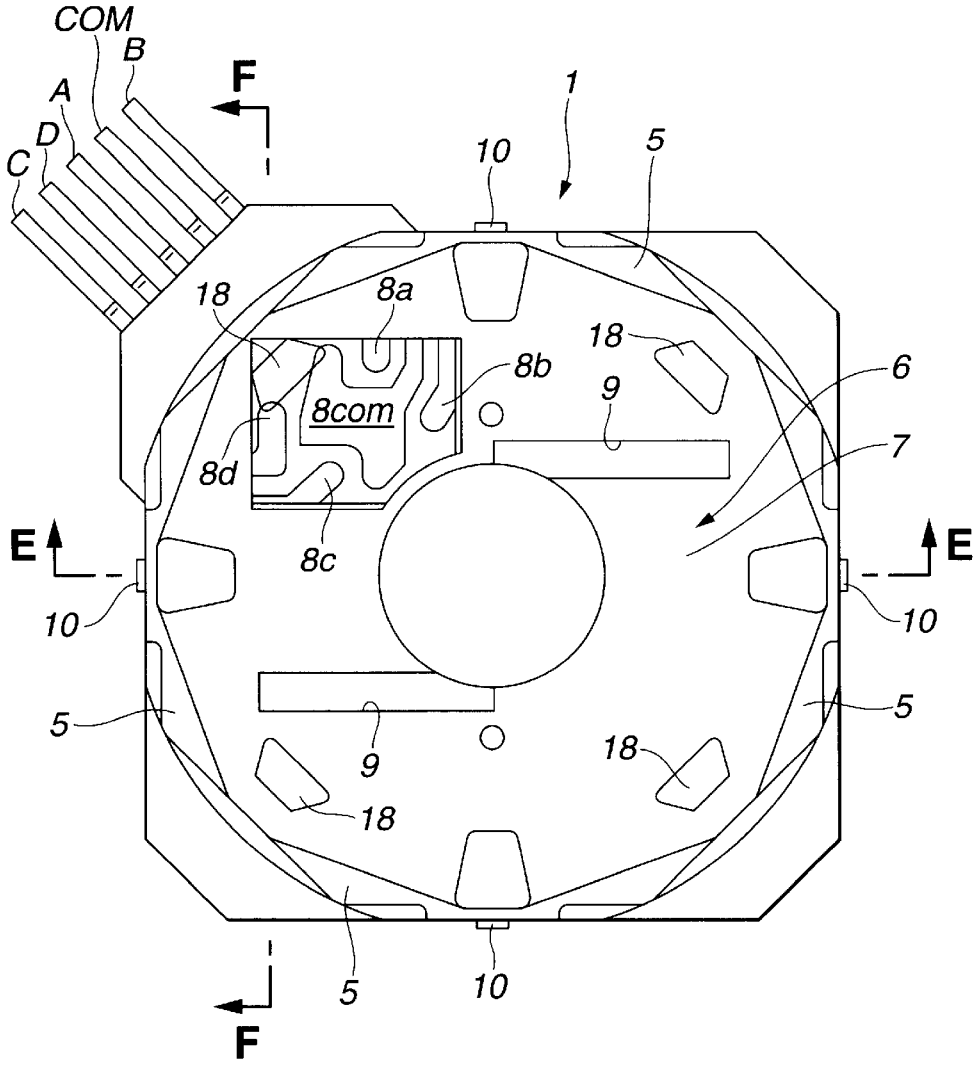
FIG. 6 is a front elevation view showing a base incorporated in the slide switch shown in FIG. 1.
Figure 7:
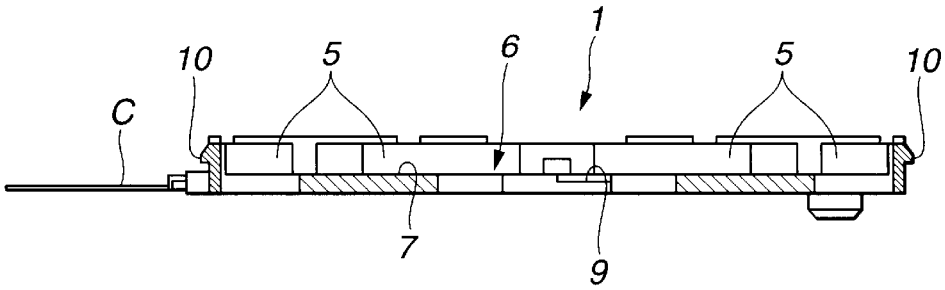
FIG. 7 is a sectional view taken along line E—E of FIG. 6.
Figure 8:
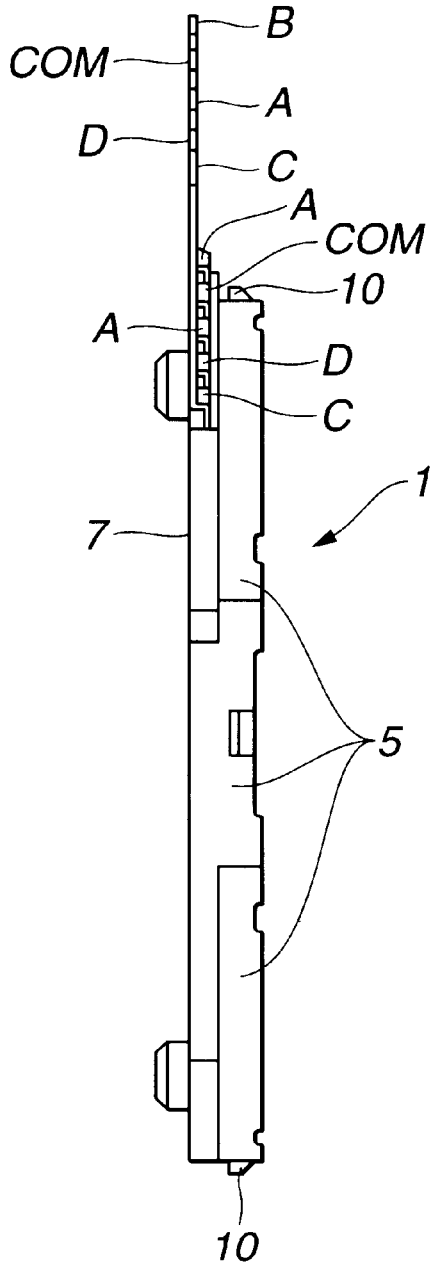
FIG. 8 is a left side elevation view of the base shown in FIG. 6.
Figure 9:
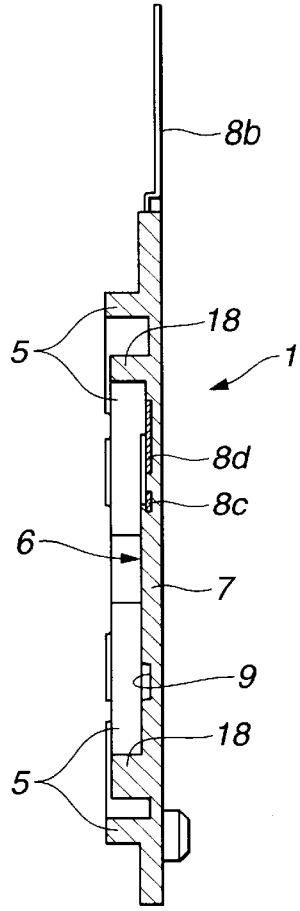
FIG. 9 is a sectional view taken along line F—F of FIG. 6.
Figure 10:
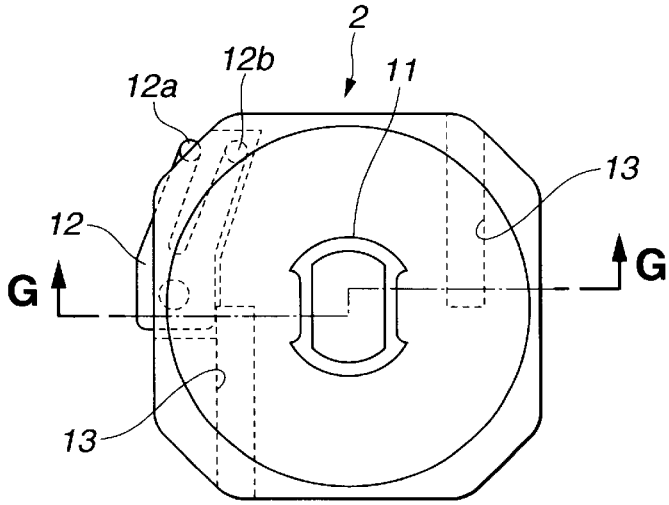
FIG. 10 is a front elevation view showing a slider incorporated in the slide switch shown in FIG. 1.
Figure 11:
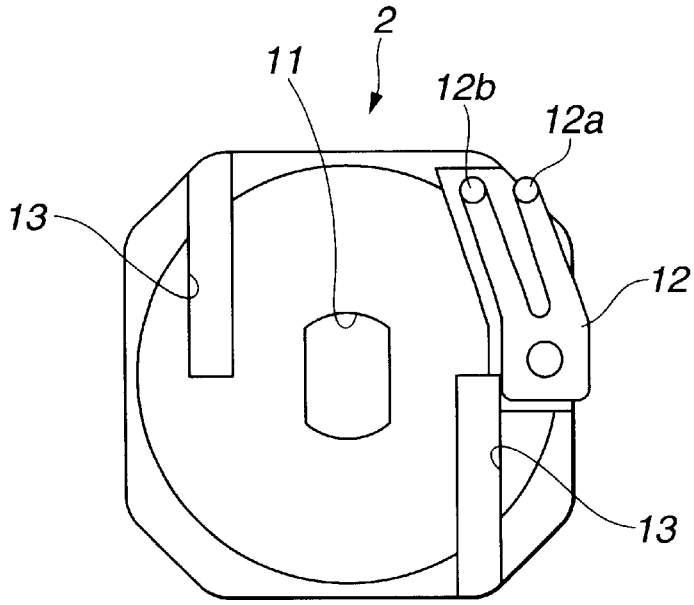
FIG. 11 is a rear view of the slider shown in FIG. 10.
Figure 12:
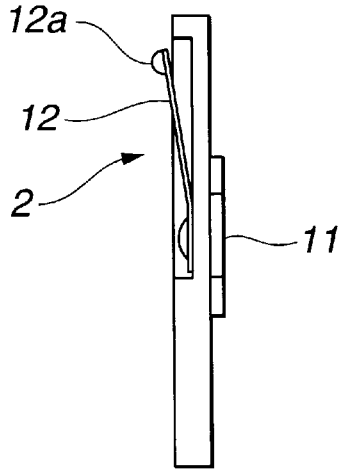
FIG. 12 is a left side view of the slider shown in FIG. 10.
Figure 15:
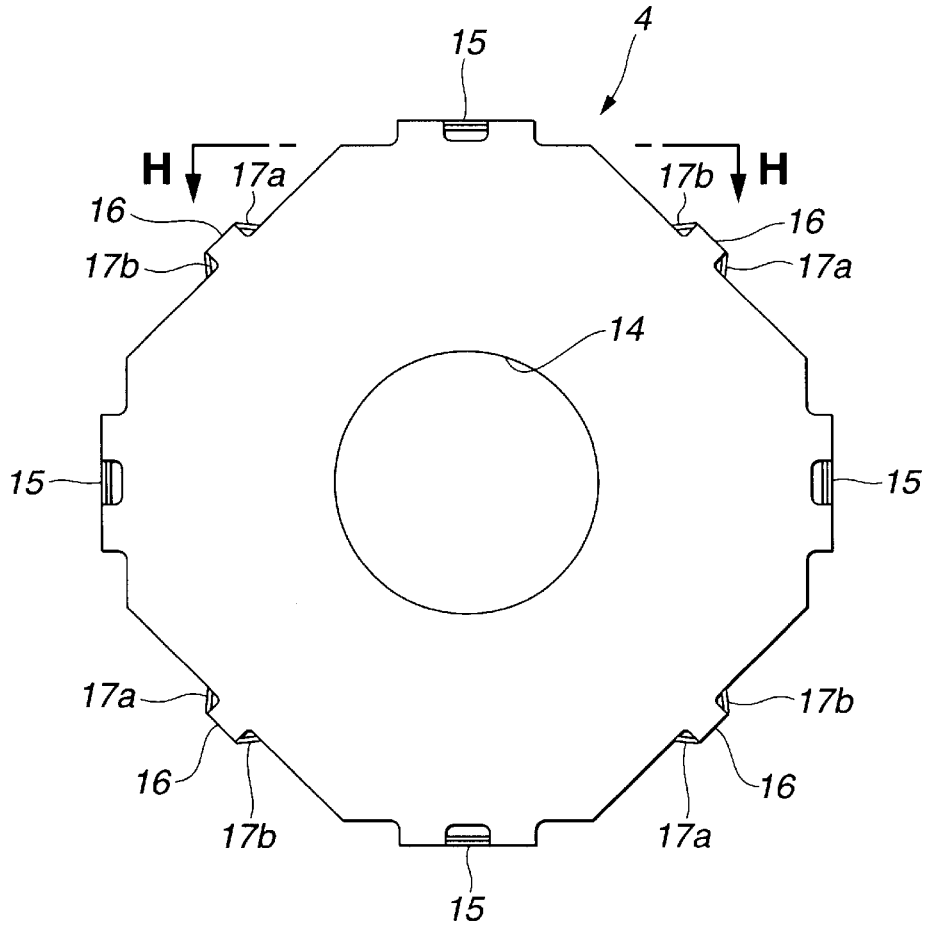
FIG. 15 is a front elevation view showing a restoring spring-equipped cover equipped with restoring springs which is incorporated in the slide switch shown in FIG. 1.
Figure 16:
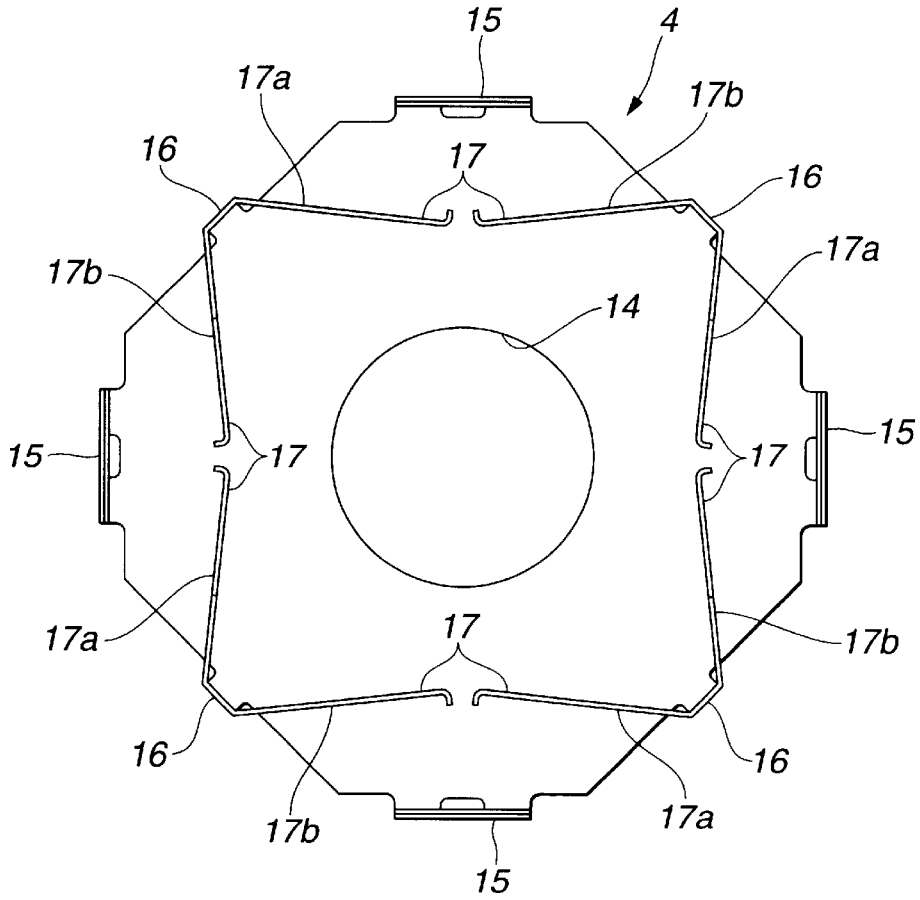
FIG. 16 is a rear view of the restoring spring-equipped cover shown in FIG. 15.
Figure 17:
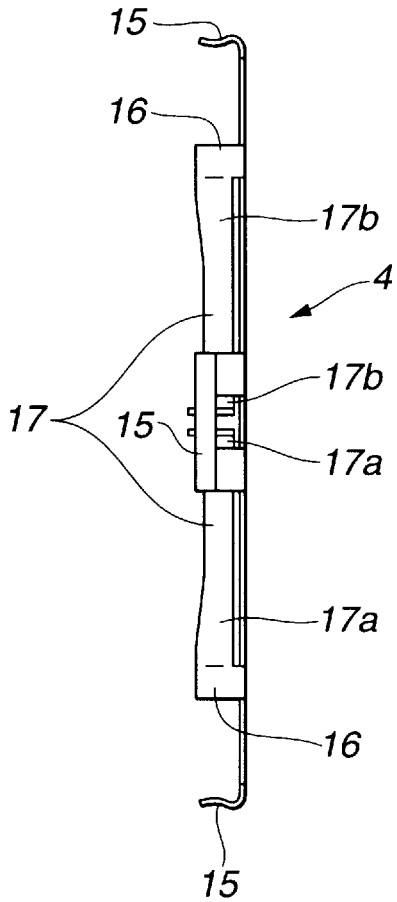
FIG. 17 is a left side view of the restoring-equipped cover shown in FIG. 15.
Figure 18:
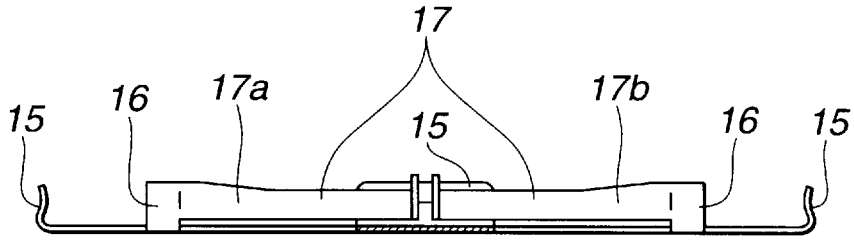
FIG. 18 is a sectional view taken along line H—H of FIG. 15.
Figure 19:
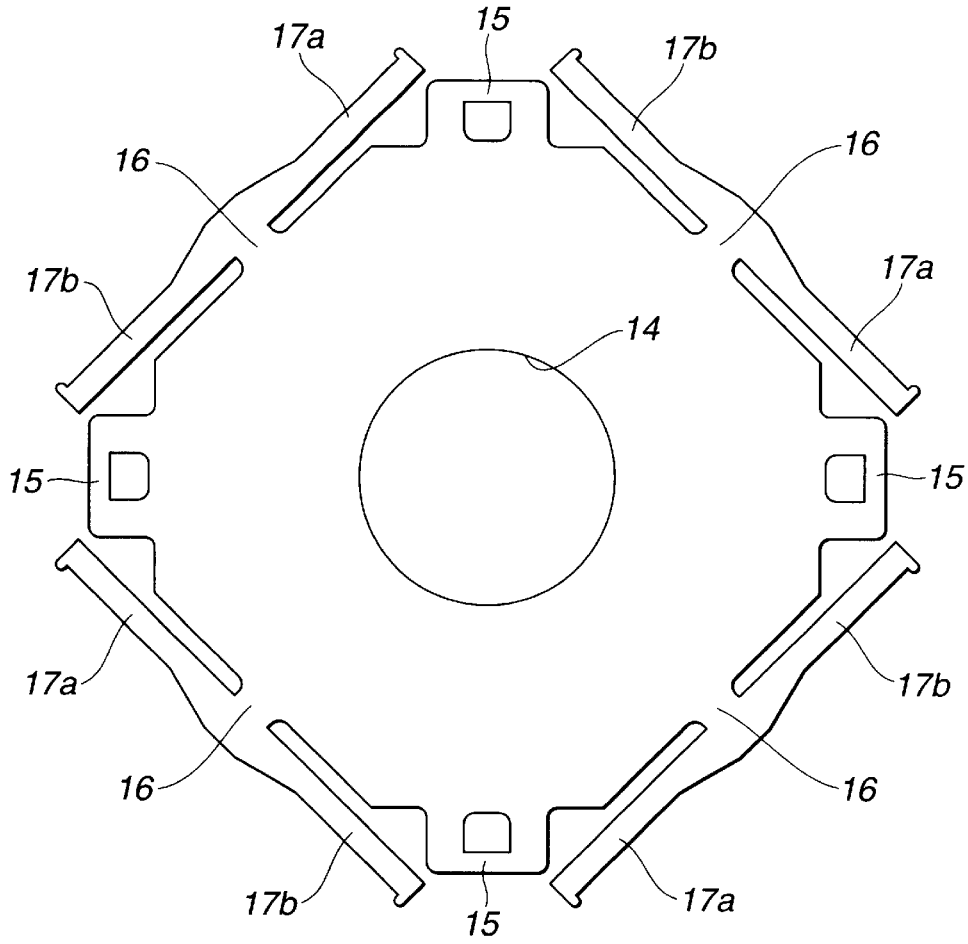
FIG. 19 is a development view of the restoring spring-cover shown in FIG. 15 prior to processing.

Now, the manner of operation of the slide switch of the illustrated embodiment thus constructed will be described. When the operation section 11 of the slider 2 inserted through the circular hole 14 is downwardly slid, the lower side of the slider 2 flexes the restoring spring 17, to thereby abut it against stoppers 18. At this time, the contacts 12*a* and 12*b* of the movable contact spring 12 initially contacted with the common fixed contact 8*com* of the fixed contacts 8 are moved, to thereby be contacted with the contacts 8*com* and 8*c*. Then, when the slider 2 is released, it is returned to the original position (central position) by the restoring force of the restoring springs 17, as shown in FIGS. 1 and 2.

Likewise, sliding of the slider in upward, left-hand and right-hand directions, followed by releasing thereof leads to selective contacting between the contacts 12*a* and 12*b* of the movable contact spring 12 and the fixed contacts 8*a*, 8*b*, 8*c*, 8*d* and 8*com*. The slider 2, as described above, may be slid in any desired directions such as longitudinal and lateral directions or oblique longitudinal and lateral directions, as well as in any desired pattern such as a circular pattern or a curved pattern. This permits the movable contacts and fixed contacts to be arranged in various manners in order to carry out any desired function such as a switching function, a mode changing-over function or the like.

As can be seen from the foregoing, the slide switch of the present invention is so constructed that the restoring springs and cover are integrally combined together to provide the restoring spring-equipped cover. Such construction leads to a reduction in the number of parts required for the slide switch and facilitates assembling thereof. Also, it leads to down-sizing of the slide switch and a reduction in manufacturing cost thereof.

Also, in the present invention, the cross slide elements each are fitted in the guide grooves of the base and slider. Such arrangement permits the slider to be smoothly accurately slid in any desired directions or any desired pattern with respect to the base.

The present invention is constructed so that the slider may be moved in all directions. Thus, the movable contacts and fixed contacts may be formed and arranged in any desired manner. Also, this permits the slider to be formed into any desired configuration such as a rectangular shape, a square shape, a triangular shape, a polygonal shape, a circular shape or the like and correspondingly the restoring springs to be varied in position, number or the like as desired, resulting in any desired action such as a switching action, a mode switching action or the like being selectively carried out.

The slide switch of the present invention may be constructed in such a manner that any desired electrical switching device such as a microswitch, a pushbutton switch, a pin switch, a leaf switch or the like is arranged either around the slider or restoring spring or around the base. Such arrangement permits sliding of the slider to partially engage the slider or restoring spring with an operational portion of the electrical switching device by abutment, pressing, contacting or the like, leading to operation of the switching device.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A slide switch comprising:

a base provided thereon with fixed contacts;

a slider provided thereon with a moveable contact spring and arranged on said base so as to be moveable in a desired direction while being guided by a combination of guide grooves and a slide elements;

a restoring spring-equipped cover provided with restoring springs to be pressed against four sides of said slider;

said restoring spring-equipped cover being mounted on said base from a side of an upper surface of said slider, so that said slider slid in any desired direction is returned to its original position by restoring force of said restoring springs;

whereby selective contacting between said movable contact spring and said fixed contacts permits switching operation and mode changing-over operation to be selectively carried out.

2. A slide switch as defined in claim 1, wherein said base includes a bottom plate and a peripheral wall arranged on a peripheral edge of said bottom plate and formed into a predetermined height, to thereby permit a recess to be defined in said base by said peripheral wall;

said slider, said slide elements and said restoring springs of said spring-equipped cover are received in said recess of said base;

said bottom plate having a plurality of fixed contacts embedded in a part thereof;

said fixed contacts have terminals led out of said bottom plate, respectively;

said bottom plate being formed on a part thereof with guide grooves of a predetermined length in which said slide elements are fitted;

said slider includes a plate member, which is so constructed that an operation section is defined on a central portion thereof and said movable contact spring is mounted on a portion thereof facing said fixed contacts of said base;

said plate member of said slider being formed with guide grooves of a predetermined length for said slide elements on a portion thereof facing said guide grooves of said base while being perpendicular thereto;

said slide elements each include plate members of an elongated shape connected to each other in a crossed manner and slidably fitted in said guide grooves of said base and slider;

said restoring spring-equipped cover includes a spring plate of a square shape formed at a central portion thereof with a circular hole;

said spring plate having engagements formed by downwardly bending projections at four corners thereof;

said restoring spring-equipped cover includes spring elements arranged so as to extend in parallel to each of four sides thereof and connected to each other at a cental portion of each side;

said spring elements being downwardly bent at said central portion and inwardly bent so as to permit distal ends thereof to face each other inwardly of each of said engagements, resulting in said restoring spring being constituted by the respective pairs of the spring elements on said sides of said slider;

said slider is received in said recess of said base while aligning said operation section of said slider with a center of said base, said slide elements being fitted in said guide grooves of said base and slider arranged in a crossed manner and said movable contact spring of said slider being contacted with said fixed contacts desired; and said restoring spring-equipped cover is arranged on an upper surface of said slider while inserting said operation section of said slider through said circular hole of said cover, so that said restoring springs are pressedly contacted with said slider on said sides thereof and said engagements at said corners of said cover are engaged with said peripheral wall of said base;

sliding of said operation section of said slider in a desired direction permitting said guide grooves and slide elements to cooperate with other to move said slider in the desired direction and concurrently permitting said restoring spring pressed on said sides of said cover in the movement direction to be deflected, so that said movable contact spring is contacted with said fixed contacts arranged at a target portion on said base, to thereby carry out a desired action such as a switching action or a mode changing-over action;

releasing of said operation section permitting said slider to be restored to the original position by restoring force of said restoring spring deflected.

3. A slide switch as defined in claim 1, wherein said base includes a bottom plate made of a dielectric material and a peripheral wall arranged on a peripheral edge of said bottom plate and formed into a predetermined height, to thereby permit a recess of a circular or polygonal configuration to be defined in said base by said peripheral wall;

said slider, said slide elements and said restoring springs of said spring-equipped cover are received in said recess of said base; and said fixed contacts are embedded in a part of said bottom plate such as, for example, a quarter region thereof defined at an upper left portion thereof in a circuit-like pattern and each having a terminal arranged so as to outwardly extend from said bottom plate;

said bottom plate being formed on a part thereof such as, for example, at quarter regions thereof defined at upper right and lower left portions thereof with guide grooves in which said slide elements are fitted.

4. A slide switch as defined in claim 1, wherein said slider includes a plate made of a dielectric material and cut out at four corners thereof;

said square plate having an operation section defined at a central portion thereof;

said plate being formed with an operation projection and a fit hole for an operation gripper;

said plate being mounted with said movable contact spring on a portion of a lower surface thereof facing said fixed contacts of said base; and said movable contact spring includes two contact spring elements;

said plate being formed with guide grooves for said slide elements on a portion of said lower surface thereof facing guide grooves of said base while being perpendicular thereto.

5. A slide switch as defined in claim 1, wherein said slide elements each are formed of two plate members of a rectangular shape connected to each other in a crossed manner and slidably fitted in guide grooves of said base and slider;

said plate members each being made of a dielectric material; and said slider is moved in longitudinal and lateral directions, in oblique longitudinal or lateral directions, in a circular pattern, in a curved pattern or in any suitable pattern or direction while keeping each of said slide elements fitted in said guide grooves of said base and slider.

6. A slide switch as defined in claim 1, wherein said restoring spring-equipped cover includes a spring plate made of a dielectric metal plate;

said spring plate being formed at a central portion thereof with a circular bole through which an operation section of said slider is inserted;

said spring plate having engagements formed by downwardly bending projections at four corners of spring plate;

said spring plate including spring elements arranged so as to be contiguous to said central portion of each of four sides of said spring plate and extend in parallel to each side;

said spring elements being downwardly bent at said central portion and inwardly bent so as to permit distal ends of the spring elements to face each other inwardly of each of said engagements, resulting in forming each of said restoring spring.

7. A slide switch as defined in claim 1, wherein said slider is formed into any suitable configuration such as a rectangular shape, a triangular shape, a polygonal shape a circular shape or the like depending on applications thereof; and said restoring spring-equipped cover is varied in number of restoring springs, position thereof or the like depending on a configuration of said slider;

whereby said slide switch may selectively carry out various actions such as a switching action, a mode changing-over action and the like as desired.

8. A slide switch as defined in claim 1, wherein any electric switching device such as a switch or the like is arranged either around said slider or said restoring springs of said restoring spring-equipped cover or around said base in correspondence to a direction of movement of said slider, so that sliding of said slider permits said slider or restoring springs to be partially engaged with said electric switching device, to thereby operate said electric switching device.

* * * * *